US005258812A

United States Patent [19]

Mahoney

[11] Patent Number: 5,258,812

[45] Date of Patent: Nov. 2, 1993

[54] METHOD AND MECHANISM FOR DOCUMENT SIZE DETERMINATION USING AN ADVANCEABLE DOCUMENT BACKGROUND MEMBER

[75] Inventor: Gregory P. Mahoney, Fairport, N.Y.

[73] Assignee: Eastman Kodak Company, Rochester, N.Y.

[21] Appl. No.: 919,793

[22] Filed: Jul. 27, 1992

[51] Int. Cl.[5] ..... G03G 21/00

[52] U.S. Cl. ..... 355/214; 355/208; 355/210; 355/233

[58] Field of Search ..... 355/233, 204, 208, 203, 355/231, 210, 311, 77, 214, 228

[56] References Cited

U.S. PATENT DOCUMENTS

| | | | |
|---|---|---|---|
| 4,200,391 | 4/1980 | Sakamoto et al. | 355/214 |
| 4,511,246 | 4/1985 | Nishiyama | 355/311 X |
| 4,692,019 | 9/1987 | Morimoto et al. | 355/204 |
| 4,873,550 | 10/1989 | Watanabe | 355/232 |
| 4,912,508 | 3/1990 | Zawadzki et al. | 355/208 |
| 4,978,992 | 12/1990 | Kusumoto et al. | 355/51 |
| 5,036,354 | 7/1991 | Miyamoto | 355/75 |
| 5,053,818 | 10/1991 | Smith | 355/214 |
| 5,072,259 | 12/1991 | Ikeda | 355/218 |
| 5,081,489 | 1/1992 | Ishikawa et al. | 355/200 |

*Primary Examiner*—A. T. Grimley
*Assistant Examiner*—Sandra L. Brasé
*Attorney, Agent, or Firm*—Tallam I. Nguti

[57] ABSTRACT

An electrostatographic reproduction apparatus for producing copies of an original document on copy sheets includes a mechanism for determining the size of the original document. The document size determining mechanism includes an optical document scanner, logic and control means and an advanceable multi-section document cover belt. The multi-section belt has a white section and a dark section which are selectably advanced over a document so as to create a color contrast between the color of the document and the color of the selected document cover forming section.

14 Claims, 3 Drawing Sheets

METHOD AND MECHANISM FOR DOCUMENT SIZE DETERMINATION USING AN ADVANCEABLE DOCUMENT BACKGROUND MEMBER

BACKGROUND OF THE INVENTION

1. Field of the Invention

This invention relates to electrostatographic reproduction apparatus which reproduce original documents, and more particularly to methods and mechanisms in such reproduction apparatus for determining the size of an original document being reproduced.

2. Background Art

Electrostatographic reproduction apparatus, such as copiers, are well known for producing, on selected substrates or copy sheets, copies of original images being carried on original documents. It is common to provide in each such reproduction apparatus a transparent platen on which to position each such document, and a white colored document cover for placing over such document to form a background surface for the document. It is also common in such reproduction apparatus to provide two or three supply sources for two or three different sizes of copy sheets from which to select when making copies as above, as well as, means for magnifying or reducing the original images on the original documents being reproduced or copied in order to achieve a desired fit on the selected size of sheet.

In order to automatically determine which particular size of copy sheet to select, or in order to automatically determine a desired degree of image magnification or reduction for a selected size of copy sheet, it is also known in the art to provide a device in the reproduction apparatus for detecting or determining the size of the original document to be reproduced. For example, in U.S. Pat. No. 4,511,246, issued Apr. 16, 1985 to Nishiyama, a document size detecting emitting elements, a pivotable light reflecting means, and light receiving elements which produce size related signals for use by a control circuit responsively to the positioning of a document between the light-emitting elements and such light-receiving elements.

In U.S. Pat. No. 4,873,550, issued Oct. 10, 1989 to Watanabe, means for sensing the size of an original document are disclosed and include a platen reference point, a document size sensor and a lens that is displaced relative to an optics assembly depending on the size of the document.

In U.S. Pat. No. 4,978,992, issued Dec. 18, 1990 to Kusumoto et al, a document size detecting apparatus is disclosed and comprises a platen, a light source, a movable scanner, a scanner reference position sensor, and means for measuring the movement of the scanner in counts. Changes in the intensity of reflected light from the platen, caused by the presence of a document, is detected by a sensor relative to a reference intensity. Points of such changes as measured in counts are used to determine document size.

In U.S. Pat. No. 5,036,354, issued Jul. 30, 1991 to Miyamoto, a document size detection device is disclosed and comprises a light-emitting unit, a document cover that has a first area for reflecting light and a second area for transmitting light, and a document presence sensor in the second area. The document sensor includes light-emitting elements and light receiving elements.

In U.S. Pat. No. 5,072,259, issued Dec. 10, 1991 to Ikeda, a document size detecting system is disclosed and includes photosensors and a document detection lamp. In U.S. Pat. No. 5,081,489 issued Jan. 14, 1992 to Ishikawa et al., a sheet size detecting system is disclosed as part of an automatic document feeder which moves documents seriatim to be reproduced. The size detecting system comprises photosensors and a timing means for counting pulses to measure the movement and hence size of a document being moved.

It should be noted, however, that besides coming in various sizes, document materials which carry original images also often come in various colors, including white. Since document covers on electrostatographic reproduction apparatus are commonly white or of a light color, there ordinarily is no reflective or optically scannable difference between a background surface formed by such a white document cover and a white or light color document material. Yet, such a white document cover is necessary in such reproduction apparatus particularly for reproducing images that are carried on a transparency material. As a consequence of these difficulties, prior art document size detecting devices or systems are each obviously limited, or have had to add costly proximity or photo sensors, even in reproduction apparatus having optical scanners for other uses therein.

SUMMARY OF THE INVENTION

It is, therefore, an object of the present invention to provide in an electrostatographic reproduction apparatus a mechanism for effectively and reliably determining the size of non-transparency document materials of various colors including white and other light colors.

In accordance with the present invention, an electrostatographic reproduction apparatus includes a document size determining mechanism that comprises an optical scanning unit for scanning between and beyond opposite edges of a surface of an original document material, and logic and control means connected to the optical scanning unit for monitoring and controlling the operation of such a scanning unit. The mechanism also comprises a plurality of different color surfaceforming means for forming a different color background-type surface for a surface of an original document material being scanned. Each such background-type surface is selectively formed such that it adjoins and extends beyond each of, at least, two opposite edges of the surface of the original document material being scanned.

BRIEF DESCRIPTION OF THE DRAWINGS

In the detailed description of the invention presented below, reference is made to the drawings, in which.

DETAILED DESCRIPTION OF THE INVENTION

Because electrostatographic reproduction machines and development apparatus for use therein are well known, the present description will be directed in particular to elements thereof which form part of or cooperate more directly with the present invention. Elements thereof not specifically shown or described herein are assumed selectable from those known in the prior art.

Figure 1:
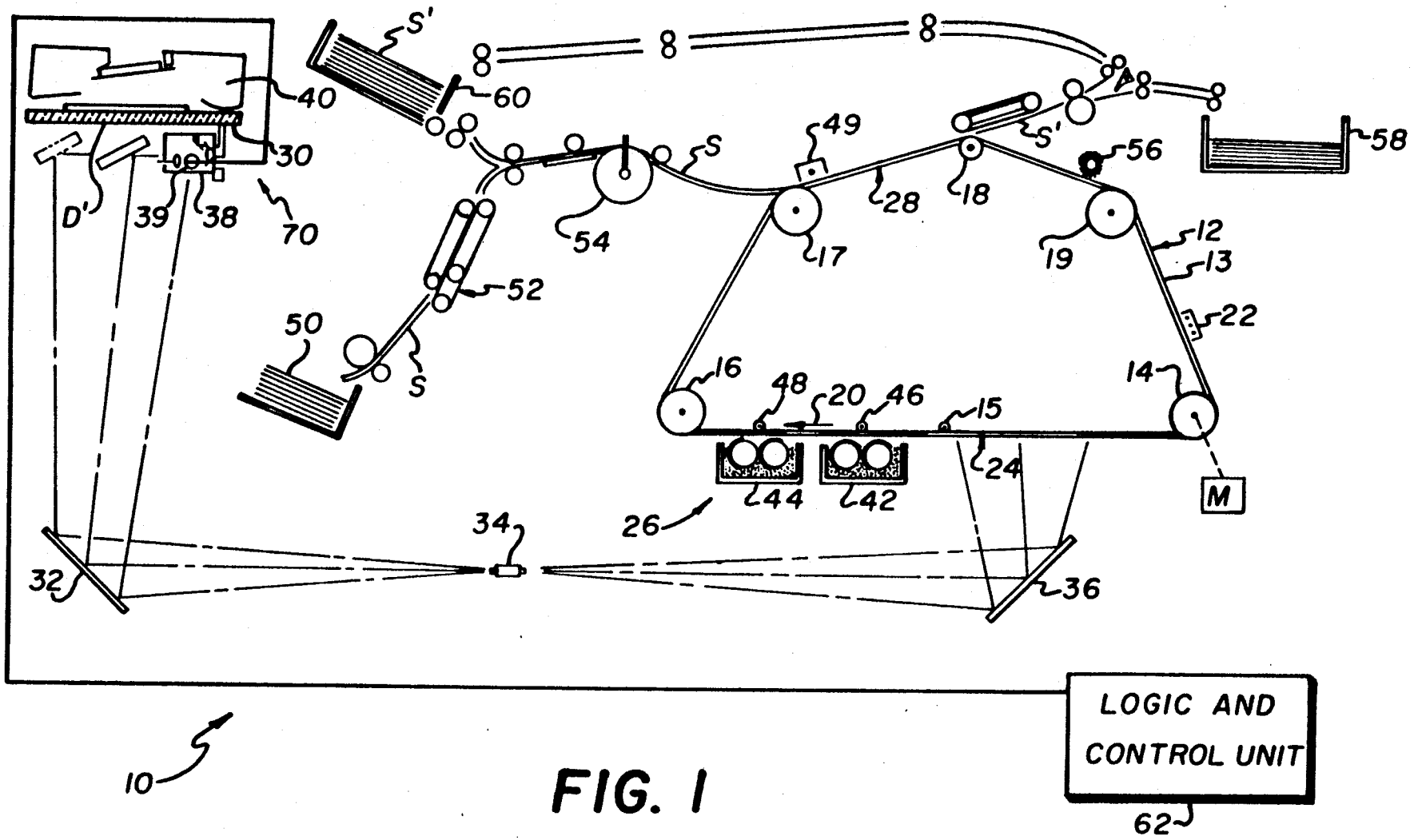
FIG. 1 is a schematic illustration of an electrostatographic reproduction apparatus or machine including the document size determining mechanism of the present invention.

Referring now to FIG. 1, an exemplary electrostatographic reproduction machine such as a copier is shown generally as 10 and is suitable for producing copies of an original image on suitable image-receiving sheets. As shown, the machine 10 includes an image-bearing member 12 having a front surface 13 with imaging and non-imaging areas. The member 12 can be a rotatable rigid drum or, for example, it can be a photoconductive web which as shown is trained about a series of transport rollers 14, 15, 16, 17, 18 and 19. The roller 14 is a drive roller and is coupled to a motor M for driving the member 12 in the direction for example of the arrow 20. Such movement of the member 12 causes successive imaging areas of the front surface 13 thereof to sequentially pass a series of electrophotographic process stations. As shown, such process stations include a charging station 22 at which each imaging area of the surface 13 receives a uniform layer of electrostatic charges. After the charging station 22, the other stations include an exposure station 24, a development station 26 and an image transfer station 28.

At the exposure station 24, light reflected from an original document D' (positioned on a transparent platen 30) is projected through an object mirror 32, a lens-shutter system 34 and an image mirror 36 onto a selected imaging area of the charged surface 13 of the photoconductor 12. Such a light projection imagewise dissipates portions of the charged imaging area to form thereon a latent electrostatic image of the original image of the document D'. The reflected light may be achieved for example by means of flash lamps (not shown) as is well known in the art, or by means of a movable optical scanner 38 which as shown is part of the document size recognition mechanism of the present invention shown as 70 (to be described in detail below). As is also well known in the art, the document D' can be positioned on the transparent platen 30 manually, or automatically by means of a recirculating document feeder, such as a feeder of the present invention shown generally as 40 (also to be described below).

The latent electrostatic image formed at the exposure station 24 is thereafter developed, that is, made visible with marking or toner particles at the development station 26. As shown, the development station 26 may include at least a development apparatus such as a magnetic brush apparatus 42 or 44 positioned adjacent the surface 13, and across a back-up roller 46 or 48, for applying charged toner particles which adhere to the electrostatic latent image to form a developed or toner image on such surface 13.

At the transfer station 28, the developed or toner image is transferred from the surface 13 onto a copy sheet S, for example, by electrostatic means using a corona charger 49. The copy sheet S is fed seriatim from a supply 50 of such sheets by transport means 52 and through a registration gate 54 where it is timed and released for receiving the toner image in proper registration at the station 28. After such toner image transfer, the transferring area of the surface 13 then moves past a cleaning element 56 which removes any residual particles from such area thus preparing the area for reuse. Meanwhile, the copy sheet S (now carrying the toner image) is moved through a fusing apparatus 58 and into an output device such as a tray 59. Alternatively, the copy or fused image-carrying sheet S may be moved through an inverter (not shown) to an intermediate holding tray 60, and then back through the registration gate 54 for receiving a second image on a second side thereof at the transfer station 28.

For monitoring and controlling the operation of the various stations and elements of the reproduction apparatus or machine 10, a logic and control unit (LCU) 62 is included therein. As is well known, the LCU 62 includes stored programs which control machine functions, and which sequentially actuate and deactuate operative elements of each of the process stations in response to monitored input signals. The LCU 62 for example may include input/output circuit boards, a bus structure consisting of a series of addresses, date and control signal lines, and a central processing unit (CPU). The CPU for example includes a test point, communication chips and two microprocessors, such as an INTEL8032 and an INTEL80286 which are used for memory storage, for communication with other dedicated microprocessors within the apparatus 10, and for controlling all other functions of the apparatus 10 that are not controlled by a dedicated microprocessor. The second microprocessor of the CPU, for example the INTEL80286 includes ROM, RAM and one-time programmable features, and is used for temporary storage of information generated by the CPU for machine control.

Figure 2:
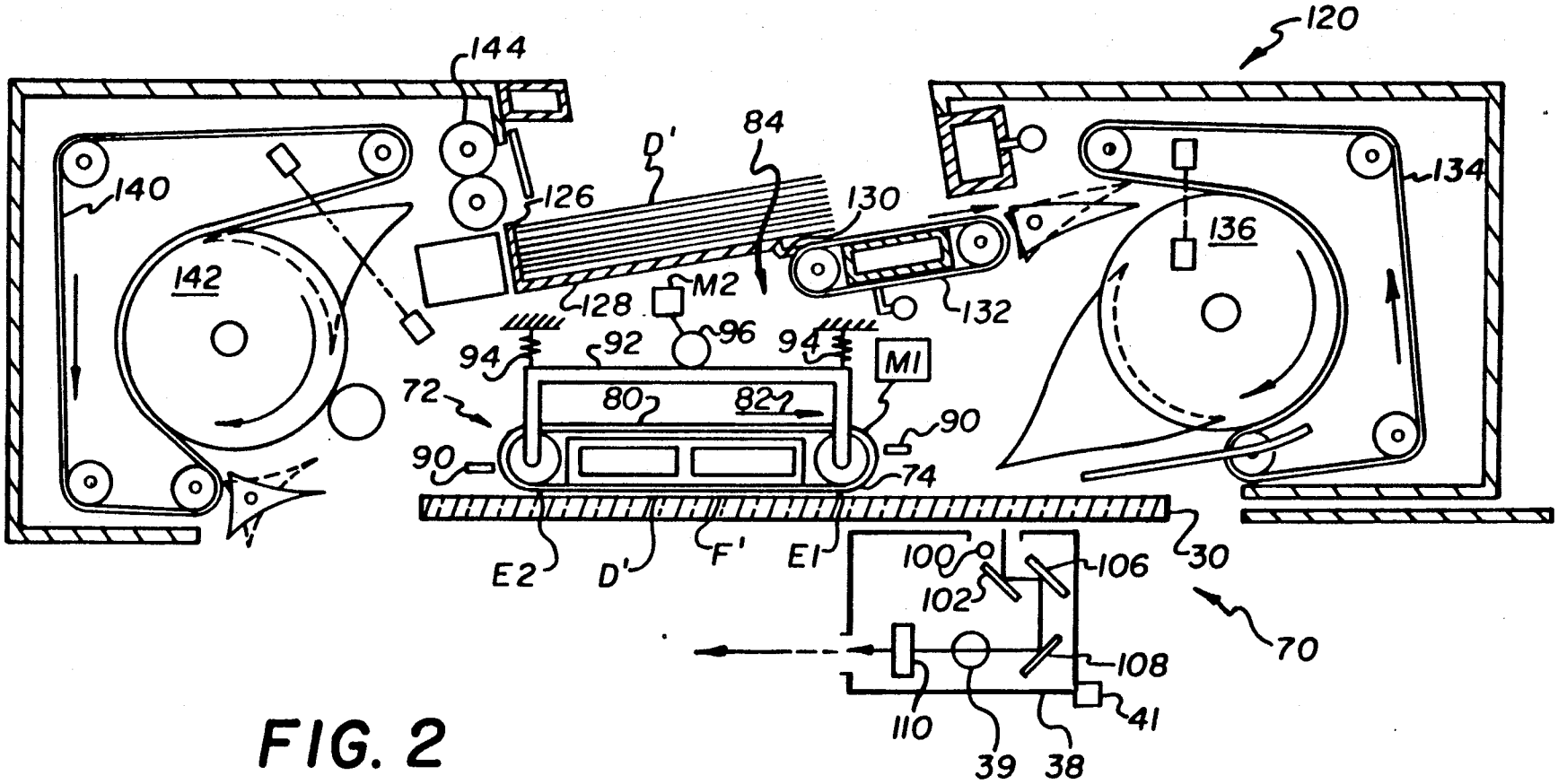
FIG. 2 is a side elevational view, in cross-section, of a recirculating feeder for use in the apparatus of FIG. 1 and including the mechanism of the present invention.
Figure 3:
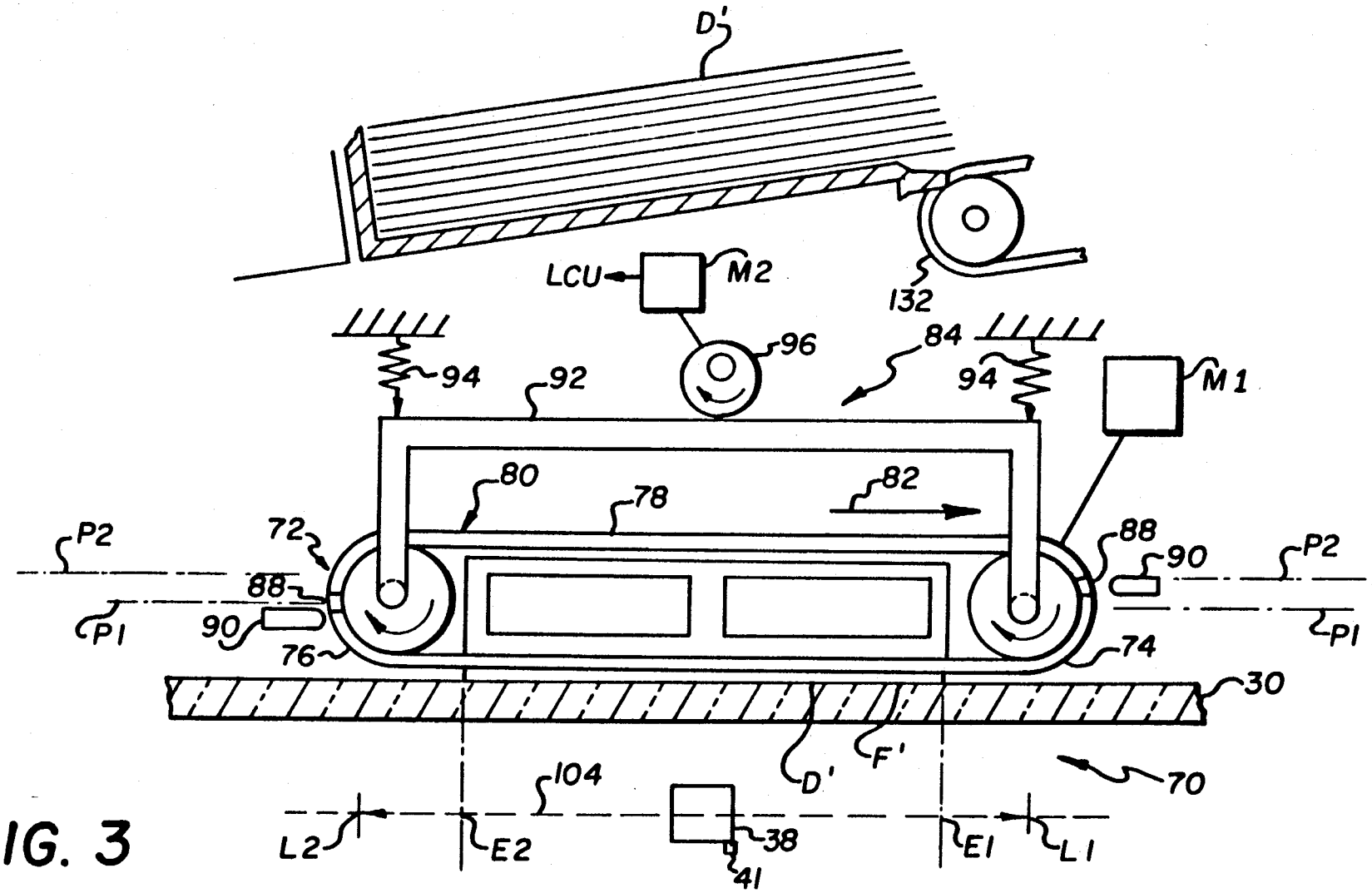
FIG. 3 is an enlarged view of the advanceable belt document cover of the mechanism of FIG. 2.

Referring now to FIGS. 1–3, the reproduction apparatus or machine 10 includes the mechanism 70 of the present invention for determining the size of each of variable color and variable size document materials D' that carries an original image being reproduced. The document size determining mechanism 70 comprises the optical scanner 38 which is movable by a stepper motor 41 for scanning between and beyond opposite edges E1, E2 of the surface F' of a document D' being scanned. The mechanism 70 also comprises a reflectance measurement unit 39 and programmed means operatively connected to the logic and control unit 62 for monitoring and control. The output of the reflectance measurement unit is connected to the logic and control unit. The mechanism 70 further comprises a plurality of different color surface-forming means 72 for selectably forming a different color background-type surface 74 for an original document material D' being scanned. Each background-type surface 74 so formed should adjoin and extend beyond each of, at least, two opposite edges, for example, the edges E1 and E2 of the surface F' of the document material D'.

As shown, the document size determining mechanism 70 also includes the transparent platen 30 for supporting a document or document material D' with the surface F' facing the scanner 38. The plurality of different color surface-forming means 72 for example comprises first and second sections 76, 78 of a document cover forming belt 80 that overlies all dimensions of document D' positioned thereunder. The first and second sections 76, 78 are each of a different color, preferably as shown, the section 76 is a light color such as white, and the section 78 is black or other dark color. The belt 80, as such, is advanceable by means of a drive Ml around a closed loop path in the direction, as shown for example by the arrows 82. Accordingly, each different color section 76, 78 thereof can be selected as desired to form a background-type surface 74 (of its color) for a document material or document D' on the platen 30.

For selectably forming such background-type surfaces, the mechanism 70 includes control means shown generally as 84 (FIG. 3) for selectively advancing the belt 80 so that the background-type surface 74 is of a color (white or black) that creates a significant color contrast against the color of the surface F' of the document material or document D'. As such, if the document material D' or its surface F' as viewed from the scanner 38 is white or light color, then the belt 80 will be selectively moved so that the black section 78 thereof forms the background-type surface 74 to such a white or light color document. The control means 84 includes marking means 88 such as a piece of reflective tape or such as a cut-out perforation in the belt for indicating a junction or boundary between the two different color belt sections 76, 78. The control means 84 also includes the drive Ml for moving or advancing the sections 76, 78 of the belt. The means 84 also included at least one sensor 90 for sensing a marking means 88 as the belt 80 is being so moved or advanced.

The belt 80 preferably has a first position shown as Pl adjacent to or overlaying a document D' on the platen 30, and a second position shown as P2 that is remote from such document D'.As shown, the belt 80 is supported on a frame 92 that is mounted resiliently by means, for example, of spring members 94 to a portion of the apparatus 10. A high and low portion eccentric cam member 96 driven by a motor M2 is mounted into rotatable contact with a flat surface of the resiliently mounted frame 92. Although not shown, the drive M2 for the cam 96 is connected to the LCU 62 for monitoring and control. In any case, rotation of the cam 96 through its high and low portions over the flat surface of the frame 92 serves to move the belt 80 between its first and second positions Pl, P2.

The optical scanner 38 of the present invention comprises, for example, an illumination lamp 100 and a scan mirror 102 (see FIG. 2) which move back and forth between points L1 and L2 along a horizontal path 104 (see FIG. 3) below the platen 30 for illuminating and scanning incremental longitudinal segments of the surface F' of the document D', as well as scanning other areas of the surface 74 that lie along the path 104 between path points L1 and E1, and L2 and E2 (FIG. 3).

Scanning light rays from the scanning mirror 102 are directed to object mirrors 106, 108 which also move with lamp 100 and scanning mirror 102. Thereafter, the reflected rays from the mirrors are directed into a projection lens 110 which also moves as part of the scanner 38. The output of the scanner 38, in the form for example of projected rays from the lens 110 are then further reflected by necessary mirror and lens assemblies 32, 34, 36 onto the charged imaging surface 13 (FIG. 1) for imagewise exposing such surface. More importantly too, the output of the reflectance sensitive measurement unit 39 of the scanner 38 as it moves along the path 104 between scanner positions L1 and L2 is appropriately fed to the logic and control unit 62. As such, continued changes in reflectance for example occurring at point El when going from L1 to El, and at point E2 in going from El to L2 are timed and converted by the LCU 62 into a document size measurement.

In accordance with the present invention, the distance along the scanning path 104 between scanner positions L1 and L2 is a fixed distance. The size of each document or document material D' as marked by the edge points El, E2 thereof along such path will, of course, vary from document to document, and so will the resulting or remaining distances between points L1 and El, and E2 and L2 along the fixed distance path 104. The actual size of a document D' can thus be determined by simply measuring the short distances L1 to El and E2 to L2. Such measuring can be accomplished by any one of a number of well known techniques including, for example, using an LCU clock, on the steps of the stepper motor 41. When the sum of the clock counts of these short distances is subtracted from the fixed predetermined clock counts for the fixed distance L1 to L2, the result is thus the size (in clock counts) of a document material or document D' that has edges at El and E2 along the path 104. Such counting of motor steps or clock counts are easily converted by the programmed means of the present invention into a distance-unit base document size measurement that has edges at E1 and E2 along the path 104. Such counting of motor steps or clock counts are easily converted by the programmed means of the present invention into a distance-unit base document size measurement.

Further, in accordance with the present invention, if there is a document D' on platen 30 and the belt 80 is in its first position Pl but the scanner 38 and LCU 62 fail to sense and register a significant difference or change in continued reflectance at any point along the path between L1 and L2, the mechanism 70 resets. For such a reset, the belt 80 is raised by means including the cam 96 and a pair of springs 94 from its first position Pl to its remote and second position P2. The belt 80 is then advanced about 180° in the direction of the arrow 82 and stopped only when a marking means 88 is sensed by a sensor 90. Such advancement of the belt 80 in effect changes the color of the background surface 74 by going from the white section 76 to the black section 78, or vice versa. The belt 80 thereafter is moved by the cam 96 from the remote position P2 into the first position Pl over the document D'. The scanner 38 is again moved from L1 to L2 or vice versa for rescanning and detecting a significant difference in reflectance at the edge points El and E2 of such document along the path 104.

Except in the case when the document or document material D' is transparent, use of a white section 76 and a black section 78 of the belt 80, is such that between the first scan, and the rescan after advancing the belt 180° from one to the other of the two different color sections, a significant color contrast should be achieved between the color of the document material D' and the background-type surface 74 formed by one of the two sections.

As shown, the mechanism 70 of the present invention can be part of an automatic recirculating document feeder 120 such as that disclosed in commonly assigned U.S. Pat. No. 5,076,560 issued Dec. 31, 1991 to Russel, the related disclosures of which are incorporated here by reference. The recirculating document feeder 120 includes a housing 122, an edge of which is attached to the reproduction apparatus 10 for pivotable movement between a first position on the platen 30 and a second position (not shown) away from the platen 30. As such, the feeder 120 can be pivoted away from the platen 30 in order to allow access for manually positioning and registering a document D' on the platen 30 for reproduction.

The feeder 120, however, includes means for holding and automatically feeding, positioning and registering sheet documents D' for reproduction without manual intervention. For holding such sheet documents D' in a stack, the feeder 120 includes an inclined sheet holding hopper 126 that has a sheet supporting surface 128. The surface 128 includes a depressed portion 130 that is located in juxtaposition to a belt and vacuum device 132 for removing sheets from the hopper. As it is well known, document sheets D' are removed and fed seriatim from the bottom of the hopper 126 by the device 132. The lead edge of each removed sheet is then grasped between a transport belt 134 and a transport wheel 136, respectively, for feeding onto the platen 30. As such, a document sheet D' can be fed from the hopper 126 into a scanning position under the belt 80 of the present invention on the platen 30. During such feeding, the belt 80 may be in its remote, second position P2 and therefore out of contact with such sheet, or it may be in its document contacting first position Pl. If in the second position P2, the belt 80 may be in a stopped state, but if in the first position P1, it must be in a moving and sheet advancing state.

In any case, once the document sheet D' has been fed or advanced into a scanning position between points L1 and L2 along the path 104 of the scanner 38, the size of such a document sheet D' can be effectively and reliably determined by the mechanism 70 provided it is not a transparency. Thereafter, the document sheet D' can be reproduced and returned to the top of the stack in the hopper 126 by means including the belt 80, a second transport belt 140, a transport wheel 142, and a pair of nip rollers 144.

As can be seen, a mechanism 70 has been provided in an electrostatographic reproduction apparatus 10 for effectively and reliably determining the size of non-transparency document materials D' regardless of the color of the document material. Alone, or as part of an automatic document feeder, the mechanism 70 includes a platen 30 on which documents are positioned manually or automatically, a scanner 38, the LCU 62, control means and an advanceable document cover belt 80 that has two halves, a black half section 78 and a white half section 76. The belt 80 can be selectively indexed about 180° around a closed loop path to selectively form a colored background-type surface 74 to a document D' being reproduced. Such advancement advantageously presents a significant color contrast between the document D' and background surface 74 thereby facilitating size recognition. The belt 80 additionally can be moved from a first position P1 in contact with a sheet document D' on the platen 30 into a remote, second position P2 so that it can be advanced or indexed 180° without disturbing or feeding a sheet document D' on such platen 30.

The invention has been described in detail with particular reference to a presently preferred embodiment, but it will be understood that variations and modifications can be effected within the spirit and scope of the invention.

What is claimed is:

1. A mechanism for determining the size of each of variable color, variable size document materials carrying original images to be reproduced in an electrostatographic reproduction apparatus having a logic and control unit, the size determining mechanism comprising:

(a) optical scanning means, including a reflectance sensitive unit connected to the logic and control unit, and having a scanning path for scanning between and beyond opposite edges of a surface of an original document material;

(b) a surface-forming means having a plurality of different color sections for each forming a different color background-type surface for an original document material being scanned, said surface-forming means having marking means for indicating a boundary between adjacent different color sections;

(c) means for sensing said marking means;

(d) means for advancing said surface-forming means selectively from one different color section to another to form a background-type surface, each said formed background-type surface adjoining and extending beyond each of, at least, two opposite edges of said surface of said original document material being scanned; and (e) programmed means, connected to the logic and control unit, for detecting changes from said reflectance sensitive unit, and for converting a timing of said detected changes to a document size measurement.

2. The mechanism of claim 1 including control means for selectively controlling the advancement of said plurality of different color sections of said surface-forming means such that a background-type surface so formed thereby has a color for creating a scannable contrast against said surface of said original document material being scanned.

3. The mechanism of claim 1 including a transparent platen for holding said original document material for scanning.

4. The mechanism of claim 1 wherein said programmed means includes a stored program for measuring the distance between two given points along said scanning path of said scanning means.

5. The mechanism of claim 1 wherein said surface-forming means is a multi-section document cover for overlaying dimensions of the backside of an original document material being scanned.

6. The mechanism of claim 5 wherein said document cover has a first position adjacent to or overlaying a document material being scanned, and a second position, remote from such a document.

7. The mechanism of claim 5 wherein said document cover comprises a movable belt having a pair of first and second different colored document-cover forming sections.

8. The mechanism of claim 7 wherein said first colored document cover section of said belt is white for forming a background-type surface for dark colored document materials, and said second section thereof is black for forming a background-type surface for light colored document materials.

9. In an electrostatographic reproduction apparatus for producing transferable toner images of original images carried on original document materials, a mechanism for determining the size of each of such document materials, the mechanism comprising:

(a) a transparent platen for supporting an original document material such that an image-carrying surface of such a document material is on said platen;

(b) optical scanning means, including a reflectance sensitive unit, having a scanning path for scanning between and beyond opposite edges of said image-carrying surface of the original document material;

(c) a pivotable recirculating feeder including a belt mounted for movement around a closed-loop path, said belt forming a document cover for overlaying a dimension of an original document material being reproduced, said belt including a first document overlaying section having a first color, and a second document overlaying section having a second color different from said first color, said belt including marking means for indicating a boundary between said first and second sections thereof;

(d) means for sensing said marking means; and (e) means for advancing said belt selectively from one of said first and second sections to the other to form a background-type surface for an original document material being scanned.

10. The mechanism of claim 9 including programmed means having a stored program for measuring the distance between first and second given points along said scanning path of said scanning means.

11. The mechanism of claim 10 wherein the scanning path of said scanning means has a distance greater than a distance, along said path, between opposite edges of said original document material being scanned.

12. The mechanism of claim 11 wherein the given first and second points for distance measurement lie along said scanning path on opposite edges of said original document material.

13. In an electrostatographic reproduction apparatus for producing transferable toner images of original images carried on variable color, variable size original document materials, a method for determining the size of each of such document materials, the method comprising the steps of:

(a) placing an original document material having a first color on a transparent platen;

(b) positioning a section of an advanceable multi-section belt having first and second color sections on said original document material on said platen such that said belt extends beyond opposite edges of said original document material;

(c) optically scanning along a scanning path extending between and beyond such opposite edges of said document material for detecting a difference in reflectance at an edge of said document material between said first color of said document material and the color of said section of the belt as positioned on said document material;

(d) advancing the section of the belt positioned over said document material from one to the other of said first and second color sections when during a scanning no difference in reflectance is detected along the scanning path at an edge of said document material; and (e) measuring by means of a logic and control unit the distance along the scanning path between points of detected differences in reflectance.

14. The method of claim 16 including the step of moving said belt from a first position on said document material to a second position away from such document material before advancing said section thereof over said document material.

* * * * *